US006168896B1

(12) United States Patent
Matsuoka et al.

(10) Patent No.: US 6,168,896 B1
(45) Date of Patent: Jan. 2, 2001

(54) PROCESS FOR PRODUCING BINDER RESIN FOR TONERS FOR DEVELOPING ELECTROSTATIC IMAGES

(75) Inventors: Sonoo Matsuoka; Kaoru Kajino; Takashi Terabayashi, all of Tochigi; Hiroshi Serizawa, Saitama, all of (JP)

(73) Assignee: Nippon Carbide Kogyo Kabushiki Kaisha, Tokyo (JP)

( * ) Notice: Under 35 U.S.C. 154(b), the term of this patent shall be extended for 0 days.

(21) Appl. No.: 09/284,770

(22) PCT Filed: Apr. 3, 1998

(86) PCT No.: PCT/JP98/01553

§ 371 Date: Apr. 20, 1999

§ 102(e) Date: Apr. 20, 1999

(87) PCT Pub. No.: WO99/12076

PCT Pub. Date: Mar. 11, 1999

(30) Foreign Application Priority Data

Aug. 28, 1997 (JP) ..... 9-245952

(51) Int. Cl.[7] ..... G03G 9/087
(52) U.S. Cl. ..... 430/137; 430/106
(58) Field of Search ..... 430/106, 109, 430/137

(56) References Cited

U.S. PATENT DOCUMENTS

| | | | | |
|---|---|---|---|---|
| 5,084,368 | | 1/1992 | Hirayama et al. | 430/109 |
| 5,780,196 | * | 7/1998 | Fujiwara et al. | 430/137 |
| 5,968,700 | * | 10/1999 | Tyagi et al. | 430/137 |

FOREIGN PATENT DOCUMENTS

| | | |
|---|---|---|
| 2-48675 | 2/1990 | (JP) . |
| 2-118583 | 5/1990 | (JP) . |
| 4-190245 | 7/1992 | (JP) . |
| 6-75422 | 3/1994 | (JP) . |
| 6-75427 | 3/1994 | (JP) . |
| 6-317935 | 11/1994 | (JP) . |
| 7-325429 | 12/1995 | (JP) . |

* cited by examiner

*Primary Examiner*—John Goodrow
(74) *Attorney, Agent, or Firm*—Young & Thompson

(57) ABSTRACT

A process for producing a binder resin for toners for developing electrostatic images, characterized by involving the step of stirring and thereby mixing a resin solution and an emulsified resin dispersion, and simultaneously or thereafter removing water and the solvent to give a solvent-free resin mixture composition.

8 Claims, 1 Drawing Sheet

PROCESS FOR PRODUCING BINDER RESIN FOR TONERS FOR DEVELOPING ELECTROSTATIC IMAGES

CROSS-REFERENCE TO RELATED APPLICATION

This application is the 35 USC 371 national stage of international application PCT/JP98/01553 filed on Apr. 3, 1998, which designated the United States of America.

TECHNICAL FIELD

The present invention relates to a process for producing a binder resin for a toner for developing an electrostatic image in electrophotography, electrostatic recording, electrostatic printing, and the like.

BACKGROUND ART

A dry development system for developing an electrostatic image has recently undergone rapid technological development.

Various image fixing methods for a dry development system are known. In is particular, a contact heat fixing system typically including a system using a fusing roller unit is superior to a non-contact heat fixing system using, e.g., a hot plate fixing unit, in thermal efficiency and particularly feasibility of fixing at a high speed and a low temperature.

According to the fusing roller fixing system, a toner image formed on an electrostatic recording medium (a photoreceptor drum) is once transferred to a transfer sheet, such as paper, and the transfer sheet is passed through fusing rollers for hot pressing thereby to fuse and fix the toner image onto the sheet.

However, if the fusing roller fixing system is applied to a conventional toner, the toner coming into contact in a molten state with the fusing roller is transferred onto the fusing roller and stains the next transfer sheet (called an offset phenomenon).

A toner for electrostatic image development is generally made up of a resinous component, a colorant comprising a pigment, magnetic powder or a dye, and additives, such as a parting agent and a charge control agent. In order to overcome the above-mentioned problem, it has been studied for securely accomplishing fixing at a fixing temperature to incorporate into the binder resin for a toner a low-molecular weight polymer so as to decrease the toner viscosity and also a high-molecular weight polymer so as to increase the modulus of elasticity of the toner and to prevent the offset phenomenon caused by sticking of part of the toner to a contact fusing roller.

Styrene-based resins are often used as such a binder resin for a toner and comprises a low-molecular weight polymer and a high-molecular weight polymer, and various methods of polymerization have been studied.

For example, Japanese Patent Laid-Open No. 48675/90 discloses a method in which a high-molecular weight polymer is produced by suspension polymerization using a polyfunctional initiator, and a low-molecular weight polymer is then produced in the presence of the high-molecular weight polymer. The resulting polymer is dried to provide a solvent-free polymer mixture comprising a high-molecular weight polymer and a low-molecular weight polymer, which is useful as a binder resin for a toner.

In general, it is relatively easy to obtain a high-molecular weight polymer by suspension polymerization using a crosslinking agent, such as divinylbenzene, diethylene glycol dimethacrylate, and trimethylolpropane dimethacrylate. However, the stage of producing a low-molecular weight polymer involves various problems. That is, in order to obtain a low-molecular weight polymer by suspension polymerization, it is necessary to use a large quantity of a chain transfer agent, such as mercaptans or halogen compounds. In using a chain transfer agent, the polymer must be subjected to post-treatment to remove an undesired odor or a residual halogen compound, which increases the cost. Further, there has been another problem that it is difficult to remove unreacted polymerizable monomers.

Japanese Patent Laid-Open No. 75427/94 discloses a technique comprising dissolving a low-molecular weight polymer obtained by solution polymerization in a polymerizable monomer which is to provide a high-molecular weight polymer and causing the system to polymerize by use of a polyfunctional initiator (having at least trifunctionality) to prepare a binder resin for a toner. However, a solution polymerization system for producing a high-molecular weight polymer encounters troubles caused by the Weissenberg effect (a phenomenon that a resin rises, clinging to a stirring rod), which makes the production difficult.

U.S. Pat. No. 5,084,368 teaches dissolving and mixing a low-molecular weight solution polymerization product and a high-molecular weight bulk polymerization product in a solvent, followed by removing the solvent in vacuum to obtain a mixture of resins different in molecular weight. However, dissolving a high-molecular weight bulk polymer in a solvent requires much labor and high cost.

Further, Japanese Patent Laid-Open No. 118583/90 discloses a technique comprising mixing a low-molecular weight polymer, a high-molecular weight polymer, and a colorant and kneading the mixture to prepare a toner for electrostatic image development. However, since polymers having largely different molecular weights and different compositions generally have poor compatibility with each other, it turned out that the resulting toner involves the drawback of each polymer, i.e., an offset phenomenon attributed to a low-molecular weight polymer and insufficient fixing in low temperatures attributed to a high-molecular weight polymer.

DISCLOSURE OF THE INVENTION

An object of the present invention is to provide a process for efficiently and easily producing a binder resin for a toner for electrostatic image development in which a low-molecular weight polymer and a high-molecular weight polymer are uniformly and compatibly dispersed and which has reduced odor and, when used in a toner, exhibits satisfactory characteristics, such as anti-offset properties, fixing properties, grindability in the production thereof, antiblocking properties (resistance to agglomeration) during storage, and developing properties in image formation.

The present invention provides a process for producing a binder resin for a toner for electrostatic image development comprising the steps of (1) mixing a resin solution and a resin emulsion with stirring and (2) removing water and the solvent simultaneously with or after the step (1) to obtain a solventless mixed resin composition.

The present invention further provides the above-described process for producing a binder resin for a toner for electrostatic image development, wherein

- the solvent of the resin solution is preferably a solvent having an SP value of 6 to 12,
- the resin solution is preferably a resin solution obtained by solution polymerization, the resin emulsion is preferably an emulsion of a polymer obtained by emulsion polymerization, the resin of the resin solution is preferably a styrene-based resin having a weight average molecular weight of not more than 200,000, and the resin of the resin emulsion is preferably a styrene-based resin having a weight average molecular weight of not less than 50,000, the resin of the resin solution preferably has a GPC peak molecular weight (Mp) of 1,500 to 30,000 and a weight average molecular weight (Mw)/number average molecular weight (Mn) ratio of less than 4.0, and the resin of the resin emulsion preferably has a GPC peak molecular weight (Mp) of 300,000 to 3,000,000, the resin of the resin solution and the resin of the resin emulsion are preferably present in proportions of 50 to 80 parts by weight and 20 to 50 parts by weight, respectively, per 100 parts by weight of their total amount, and/or the process preferably includes a step of (3) kneading after the step of (1) mixing with stirring and (2) removing water and the solvent.

The present invention furthermore provides a process for producing a toner for electrostatic image development comprising the steps of (1) mixing a resin solution and a resin emulsion with stirring, (2) removing water and the solvent simultaneously with or after the step (1) to obtain a solventless mixed resin composition, and (4) incorporating a colorant into the solventless mixed resin composition.

According to the present invention, a binder resin for a toner for electrostatic image development can be produced efficiently and easily by grinding the solventless mixed resin composition thus prepared. The binder resin for a toner obtained in the present invention provides a toner for electrostatic image development in which a low-molecular weight polymer and a high-molecular weight polymer are dispersed uniformly and compatibly and which gives off little odor and exhibits pronouncedly excellent characteristics such as anti-offset properties, fixing properties, grindability in the production, antiblocking properties (resistance to agglomeration) during storage, and developing properties in image formation.

THE BEST MODE FOR CARRYING OUT THE INVENTION

Figure 1:
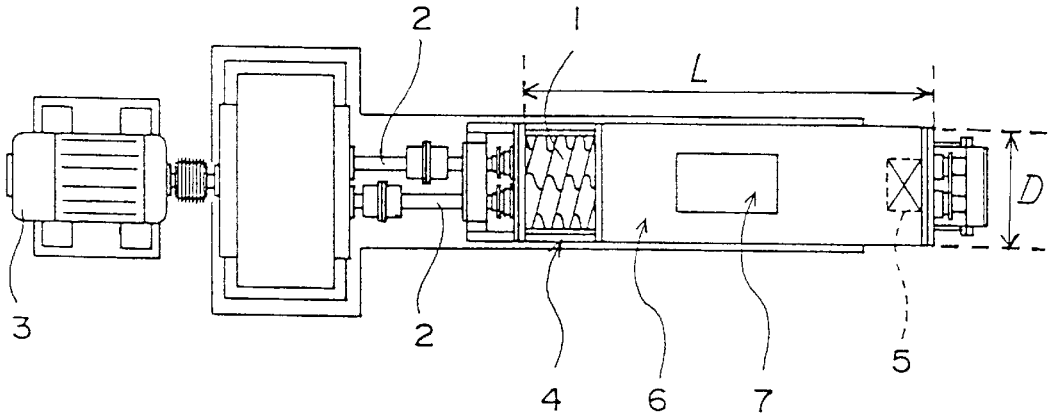
FIG. 1 is a schematic plan view of a twin-screw continuous mixer which is used for preference to carry out the steps of mixing with stirring and removing water and the solvent.

The process for producing a binder resin for a toner for electrostatic image development according to the present invention will be described in detail.

The step of mixing a resin solution and a resin emulsion with stirring is a step of mixing a resin solution and a resin emulsion by stirring mechanically or by any other means.

The step of mixing with stirring is preferably carried out at or above the glass transition point of the resin of the resin solution, particularly at or above a temperature higher than the glass transition point by at least 20° C., whereby the resulting mixture of the resin solution and the resin emulsion has a uniform composition and provides a toner with improved physical properties.

During the step of mixing with stirring, the emulsified resin particles of the resin emulsion come into contact with the resin solution and united therewith while being in a dispersed state. This mechanism of action seems to be accelerated under the above preferred temperature condition to bring about the above-described advantage of the step of mixing with stirring.

The step of mixing with stirring may be performed either under atmospheric pressure or under pressure so as to suppress evaporation of the water content and the solvent.

The step of removing water and the solvent is a step of removing water and the solvent from the mixture as obtained by the step of mixing with stirring through evaporation. This step provides a solventless mixed resin composition from which most of the water content has been removed. Where the mixture contains volatile impurities such as residual monomers and an organic solvent, such volatile impurities can be removed concomitantly by this step.

The step of removing water and the solvent can be carried out by heating the mixture at or above the equilibrium evaporation temperature of the water and the solvent in the mixture and, more effectively, under reduced pressure. When the step of removing water and the solvent is conducted under atmospheric pressure, the temperature of the mixture can be set at around 100° C. in the initial stage of mixing the resin solution and the resin emulsion and then increases as the removal of water and the solvent proceeds.

The step of removing water and the solvent may be performed either after completion of, or simultaneously with, the step of mixing with stirring. The latter mode is preferred for efficiency.

On starting the step of removing water and the solvent, the water content and the solvent content of the mixture begin to decrease to remove most of the water and the solvent at last. Where the step of removing water and the solvent is carried out simultaneously with the step of mixing with stirring, evaporation of water and the solvent from the mixture and reduction in water content and solvent content start upon starting the step of mixing with stirring.

Where it is desired for the mixture of the resin of the resin solution and the resin of the resin emulsion to have a highly uniform composition, the steps of mixing with stirring and removing water and the solvent are preferably followed by a step of kneading.

The term "kneading" as used herein means mechanically kneading the solventless mixed resin composition from which most of water and the solvent has been removed.

In this case, the kneading may be carried out under such a condition that causes small amounts of residual water and the residual solvent to be removed.

It is preferable for securing further improved uniformity of the mixture that the step of kneading be carried out with at least one of the resin of the resin solution and the resin of the resin emulsion being in a molten state.

While not limiting, the steps of mixing the resin solution and the resin emulsion with stirring, removing water and the solvent, and, if desired, the step of kneading can be practiced by, for example, a method of using an apparatus having a heating function, a mixing function, and a function of removing water and the solvent through evaporation.

Preferred apparatus having these functions include a pressure kneader, a Banbury mixer, a roll mill, an extruder, a single- or twin-screw continuous mixer, a continuous desolvating mixer, and a drier.

A single- or twin-screw continuous mixer, a continuous desolvating mixer or a drier is preferred in that the step of mixing with stirring, the step of removing water and the solvent, and the kneading step, which makes the resin of the resin solution and the resin of the resin emulsion be dispersed more uniformly, can be performed continuously and efficiently in a single apparatus.

While various twin-screw continuous mixers are available, those having two self-cleaning type shafts having fixed thereto a plurality of paddles or two selfcleaning type screws, particularly those in which paddles of each shaft rotate in contact with the inner wall of the barrel of the mixer while the paddles of one shaft come into contact with those of the other, are still preferred for their high mixing effect and satisfactory workability. These twin-screw continuous mixers are preferably capable of delivering a fluid having a viscosity of 10 to $1\times10_8$ cps from the feed opening to the discharge end through revolution of paddles or screws.

The terminology "self-cleaning" means such properties that the paddles or screws hardly allow the mixture to remain sticking thereto and require no cleaning after use.

Twin-screw continuous mixers of this type are known per se and commercially available under trade names of KRC Kneader (manufactured by Kurimoto, Ltd.), Continuous Kneader (manufactured by Fuji Powdal K.K.), Compatible Twin-screw Extruder (manufactured by Plastic Kogaku Kenkyusho K.K.), etc.

Suitable single- or twin-screw continuous desolvating mixers or driers that are commercially available include Paddle Drier manufactured by Nara Kikai Seisakusyo K.K.

By use of the above-described apparatus, the mixing with stirring and the kneading can be practiced by mixing the mixture with stirring through revolution of the screws or paddles fixed to the stirring shafts, and the removing of the water and the solvent can be efficiently carried out by heating the mixture to a temperature not lower than the equilibrium evaporation temperature of water present in the mixture by means of a heating jacket or an electric heater usually set on the apparatus or by heating under reduced pressure.

Alternatively, the removing of the water and the solvent can be conducted by well-known flash distillation, in which the mixture is, if desired as heated, introduced into a reduced pressure zone to evaporate water and solvent to make the mixture into a substantially solventless state.

The mixing with stirring and the removing of the water and the solvent can be performed in the same apparatus or separate apparatus, preferably in the same apparatus.

Where the kneading is conducted, the mixing with stirring, the removing of the water and the solvent and the kneading can be carried out in the respective apparatus; or the mixing with stirring and the removing of the water and the solvent can be carried out in the same apparatus (first apparatus) and the kneading in a separate apparatus (second apparatus); or the mixing with stirring in the first apparatus and the removing of the water and the solvent and the kneading in a separate apparatus (second apparatus); or all of the mixing with stirring, removing of the water and the solvent and kneading in a single apparatus. Where a particularly uniform mixed resin composition is desired, it is preferable to carry out the mixing with stirring and the removing of the water and the solvent in a first apparatus and to carry out the kneading in a second apparatus. Where weight is put on satisfactory workability, it is preferable to carry out all of the mixing with stirring, the removing of the water and the solvent and the kneading in a single apparatus.

In carrying out the mixing with stirring and the removing of the water and the solvent in a first apparatus and the kneading in a second apparatus, it is preferable for the solventless mixed resin composition discharged from the discharge end of the first apparatus to have a water content of not more than 20% by weight, particularly not more than 5% by weight.

Figure 2:
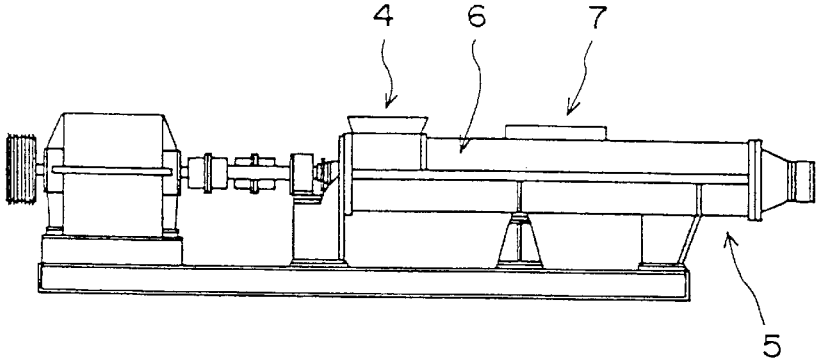
FIG. 2 is a schematic side view of the twin-screw continuous mixer.

FIGS. 1 and 2 schematically illustrate the structure of a preferred twin-screw continuous mixer. FIG. 1 provides a schematic plan view, and FIG. 2 a schematic side view. Embodiments for carrying out the mixing with stirring and the removing of the water and the solvent simultaneously followed by the kneadng by the use of the twin-screw continuous mixer will be explained by referring to FIGS. 1 and 2.

The twin-screw continuous mixer used here has two shafts 2 each having fixed thereto a number of paddles 1. The shafts 2 are revolved by a motor 3, whereby a resin solution and a resin emulsion which are continuously fed through a feed opening 4 is stirred and mixed at a temperature not lower than the glass transition point of resin in the resin solution and forwarded toward a discharge end 5.

Meanwhile, the mixture is heated by means of a heating jacket 6 through which a heating medium, such as steam or oil, is circulated or an electric heater (not shown) to discharge water in the resin emulsion and the solvent in the resin solution from a vent hole 7. The feed rate of the resin solution and the resin emulsion is usually adjusted by a means (not shown) so as to leave space between the upper surface of the moving mixture and the heating jacket so that the evaporated water and the solvent may pass through the space and discharged from the vent hole 7. While the temperature of the mixture in the vicinity of the feed opening 4 is 100 to 110° C. because of a high water content and a high solvent content, it gradually increases as the water and solvent content decreases. Finally, most of the water and solvent content of the mixture is removed. Thereafter, the kneading is conducted preferably at a temperature at which resin in the resin solution melts. Through the kneading, resin in the resin solution and resin in the resin emulsion are dispersed more uniformly. In the melt zone where the kneading is effected, residual water and solvent are also evaporated and discharged from the vent hole 7.

Depending on the end use, the mixture (solventless mixed resin composition) btained from the discharge end 5 can be continuously transferred to another pparatus where it is processed into granules, pellets or flakes.

In the case where the mixing with stirring, the removing of the water and the solvent and the kneading are performed by means of the above-illustrated twinscrew continuous mixer, such conditions as the heating temperature of the jacket and the retention time necessary for carrying out the mixing with stirring, the removing of the water and the solvent and the kneading vary depending on the kinds of resin in the resin solution and the solvent, the water content of the resin emulsion, a desired degree of dispersion and a desired water content of the resin solution and the resin emulsion in the mixture obtained from the discharge end 5, the throughput capacity of the apparatus, and other factors. Nevertheless it is easy for one skilled in the art to decide these conditions theoretically and experimentally provided that the above-mentioned factors are once specified.

In general, the time and the length of the zone necessary for achieving the mixing with stirring and the removing of the water and the solvent can be shortened by increasing the rate of removing of the water and the solvent by, for example, raising the heating temperature. It follows that the time and the length of the zone for conducting the kneading increase.

For example, when polystyrene resins as resin in the resin solution and resin in the resin emulsion are treated under atmospheric pressure, the temperature of the heating jacket can be set at 120 to 300° C., preferably 160 to 250° C., and the retention time from the feed opening 4 to the discharge end 5 can be set usually at 1 to 60 minutes, preferably at 5 to 30 minutes, while somewhat varying according to the kneading capacity of the apparatus and other factors.

With an apparatus having a vent hole 7 for discharging water and solvent as in the above-described apparatus, an increase in open area of the vent hole 7 for water discharge leads to an increase in efficiency of the removing of the water and the solvent from the mixture having a high water content and a high solvent content. That is, it is preferable for attaining high efficiency of the removing of the water and the solvent that the sum of the open area of the feed opening 4 and that of the vent hole 7, which are provided on the upper part of the barrel, ranges from 15 to 100% of the product of the length and the width of the barrel (corresponding to L and D, respectively, shown in FIG. 1). The sum of the open areas being 100%, the upper part of the barrel of the twin-screw continuous mixer is open over the whole length, which is one of preferred embodiments. In this case, the jacket is not provided on the upper part of the barrel. The jacket is provided only on the lower part, or it is replaced with a heating medium which is to be circulated within the revolving shafts or paddles.

The resin solution which can be used in the present invention is a solution of a resin dissolved in a solvent. The solvent content in the resin solution exceeds 10% by weight, preferably ranges from 20 to 80% by weight, particularly preferably from 30 to 70% by weight.

In preparing the binder resin for a toner for electrostatic image development according to the present invention, the resin of the resin solution is preferably used as a low-molecular weight component of the binder resin for a toner.

The resin of the resin solution preferably has a molecular weight Mp of 1,500 to 30,000, particularly 2,000 to 20,000, in terms of the maximum molecular weight (peak molecular weight) in the gel-permeation chromatogram (GPC).

If the Mp is less than the lower limit, the resulting toner is, while satisfactory in fixing properties, apt to agglomerate in a developing machine, resulting in reduction of a developer service life, deterioration of toner storage stability, and caking when stored at high temperatures. If the Mp exceeds the upper limit, the toner is prevented from causing the spent-toner phenomenon or getting excessively finer but exhibits insufficient fixing properties at low temperatures, i.e., the toner has a raised lower limit of fixing temperature, and the toner tends to cause cold offset.

The resin of the resin solution preferably has a weight average molecular weight Mw of 1,000 to 200,000, particularly 1,000 to 100,000, especially 1,000 to 40,000.

If the Mw is less than the lower limit, the resulting toner is, while satisfactory in fixing properties, apt to agglomerate in a developing machine, resulting in reduction of a developer service life, deterioration of toner storage stability, and caking when stored at high temperatures. If the Mw exceeds the upper limit, the toner is prevented from causing the spent-toner phenomenon or getting excessively finer but exhibits insufficient fixing properties at low temperatures, i.e., the toner has a raised lower limit of fixing temperature, and the toner tends to cause cold offset.

The resin of the resin solution preferably has a weight average molecular weight Mw to number average molecular weight Mn ratio, Mw/Mn, of less than 4. If the Mw/Mn is 4 or more, the fixing properties are deteriorated.

Any kind of resins can serve as the resin of the resin solution with no particular limitation as long as it is applicable as a binder resin for a toner. Examples of useful resins include acrylic resins, styrene-based resins, epoxy resins, polyester resins, and styrene-butadiene resins. From the viewpoint of ease of securing performance properties as a toner, styrene-based resins are preferred.

The styrene-based resins are homopolymers of a styrene monomer or copolymers mainly comprising a styrene monomer. Suitable styrene monomers include styrene, o-methylstyrene, m-methylstyrene, p-methylstyrene, α-methylstyrene, p-ethylstyrene, 2,4-dimethylstyrene, p-n-butylstyrene, p-t-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene. Styrene is the most suitable of them.

Comonomers to be used in the styrene copolymers are not particularly limited as long as they are copolymerizable with the above-described styrene monomers. Acrylic monomers are preferred. Examples of suitable acrylic monomers are methyl acrylate, ethyl acrylate, n-butyl acrylate, isobutyl acrylate, ethylhexyl acrylate, methyl methacrylate, ethyl methacrylate, n-butyl methacrylate, isobutyl methacrylate, lauryl methacrylate, and stearyl methacrylate. n-Butyl acrylate, ethylhexyl acrylate, n-butyl methacrylate, and lauryl methacrylate are particularly preferred.

The acrylic components are preferably such that a copolymer obtained by copolymerizing with the above-described styrene monomer under ordinary conditions may have a glass transition temperature ranging from 40 to 80° C., particularly from 50 to 70° C.

The solvent of the resin solution is not particularly limited, and any solvent can be used. Examples of useful solvents include aliphatic hydrocarbons, such as pentane, hexane, heptane, and octane, and isomers thereof, alicyclic hydrocarbons, such as cyclohexane and methylcyclohexane; aromatic hydrocarbons, such as benzene, toluene, xylene, ethylbenzene, and diethylbenzene; halogenated hydrocarbons, such as 1-chlorobutane, amyl chloride, ethylene dibromide, methylene chloride, ethylene dichloride, propylene dichloride, dichloropentane, chloroform, 1,1,2-trichloroethane, 1,2,3-trichloropropane, carbon tetrachloride, 1,1,2,2-tetrachloroethane, trichloroethylene, perchloroethylene, epichlorohydrin, monochlorobenzene, dichlorobenzene, trichlorobenzene, and fluorohydrocarbons; alcohols, such as methyl alcohol, ethyl alcohol, allyl alcohol, propyl alcohol, butyl alcohol, amyl alcohol, hexyl alcohol, and octyl alcohol, and isomers thereof; amines, such as diethylamine, triethylamine, butylamine, diamylamine, propylenediamine, aniline, dimethylaniline, cyclohexylamine, monoethanolamine, diethanolamine, triethanolamine, pyridine, and quinoline; ketones, such as acetone, methyl ethyl ketone, methyl propyl ketone, methyl isobutyl ketone, methyl amyl ketone, methyl hexyl ketone, diisobutyl ketone, cyclohexanone, and methylhexanone; ethers, such as ethyl ether, isopropyl ether, n-butyl ether, n-hexyl ether, dioxane, methyl cellosolve, ethyl cellosolve, butyl cellosolve, methyl carbitol, ethyl carbitol, and butyl carbitol; esters, such as diethyl carbonate, methyl formate, ethyl formnate, butyl formate, methyl acetate, ethyl acetate, propyl acetate, butyl acetate, amyl acetate, ethyl propionate, butyl propionate, amyl propionate, ethyl butyrate, butyl butyrate, amyl butyrate, diethyl oxalate, dibutyl oxalate, methyl lactate, ethyl lactate, and butyl lactate, and isomers thereof; petroleum hydrocarbons, such gasoline, petroleum ether, petroleum benzine, ligroin, mineral spirit, kerosine, gas oil, and heavy oil; nitrohydrocarbons, such as nitromethane, nitroethane, nitropropane, and nitrobenzene; nitriles, such as acetonitrile and benzonitrile; acetaldehyde diethylacetal, tetrahydrofuran, furfuryl acetate, and carbon disulfide. These solvents can be used either individually or as a combination of two or more thereof Of the above solvents, aliphatic hydrocarbons, alicyclic hydrocarbons, aromatic hydrocarbons, ketones, ethers, and esters are preferred for their satisfactory compatibility with resins. Still preferred of them are those having a boiling point of 50 to 170° C. from the standpoint of effective removal by evaporation.

The solvent preferably has a solubility parameter (SP value) of 6 to 12, particularly 7 to 11, especially 8 to 10. The solvent whose SP value falls within the above range exhibits good compatibility with resins so that the resin of the resin solution and the resin of the resin emulsion tend to show good compatibility when mixed by stirring.

The resin solution can be obtained either directly by polycondensation, addition polymerization, solution polymerization of vinyl monomers, and the like or by dissolving a resin in a solvent. For ease of preparation, the method for directly obtaining the resin solution by solution polymerization of vinyl monomers is preferred.

The solution polymerization is carried out by heating the starting mixture comprising the monomer, the solvent, and a catalyst soluble in the monomer to a polymerization temperature. The polymerization can be performed in a batch manner, or addition of the starting materials, polymerization, and discharge of the polymer can be effected continuously in a single or multiple stage. It is preferred for efficiency that solution polymerization be carried out continuously and the product be fed directly to an apparatus for mixing with the resin emulsion.

The polymerization temperature of the solution polymerization is preferably 40 to 250° C., still preferably 60 to 230° C., particularly preferably 70 to 220° C. If the polymerization temperature is lower than the lower limit, the reaction rate is low. If the polymerization temperature exceeds the upper limit, the polymerization reaction is apt to be accompanied by decomposition of the polymer to increase oligomers having a molecular weight of 500 or smaller in the resulting resin. A toner prepared by using such a resin is liable to have poor storage properties, cause a spent-toner phenomenon, and become finer.

An arbitrary conventional oil-soluble initiator can be used as a catalyst of the solution polymerization. Suitable initiators include benzoyl peroxide, t-butyl hydroperoxide, di-t-butyl hydroperoxide, cumene hydroperoxide, t-hexyl hydroperoxide, p-menthane hydroperoxide, and diazobisisobutyronitrile. In particular, initiators suitable for polymerization at 170° C. or higher include t-butyl hydroperoxide and di-t-butyl hydroperoxide.

The free radical initiator is preferably used in an amount of 0 to 5% by weight, particularly 0.03 to 3% by weight, especially 0.05 to 1% by weight, based on the total monomer (s).

It is preferred to select the temperature and the retention time for reaction so that the resulting low-molecular weight styrene polymer may have a conversion of 80% or higher, preferably 90% or higher, still preferably 95% or higher.

The resin emulsion for use in the present invention is not particularly limited as long as it contains a resin dispersed in an emulsified state, and any type of resin emulsions can be used. For example, a resin emulsion prepared by forcing a resin to be emulsified in water and a resin emulsion as prepared by emulsion polymerization can be used. A resin emulsion obtained by emulsion polymerization is preferred for its stability during storage and while being mixed with a resin solution.

The resin of the resin emulsion is preferably used as a high-molecular weight polymer component of the binder resin for a toner and is preferably combined with the resin of the resin solution serving as a low-molecular weight polymer component of the binder resin for a toner.

Where the resin of the resin solution serving as a low-molecular weight polymer component and the resin of the resin emulsion serving as a high-molecular weight polymer component are combined to provide a binder resin for a toner, the resin of the resin solution is preferably used in a proportion of 50 to 80 parts by weight, particularly 55 to 75 parts by weight, and the resin of the resin emulsion 20 to 50 parts by weight, particularly 25 to 45 parts by weight, per 100 parts by weight of the their total amount. If the proportion of the resin of the resin solution is less than the above lower limit (i.e., if the proportion of the resin of the resin emulsion is more than the above upper limit), the resulting toner, while satisfactory in anti-offset properties, exhibits poor fixing properties in a low temperature region, raising the lower limit of a fixing temperature. If the proportion of the resin of the resin solution is more than the above upper limit (i.e., if the proportion of the resin of the resin emulsion is less than the above lower limit), the fixing properties are satisfactory, but the toner is apt to cause hot offset, making the fixing temperature latitude narrower.

The resin of the resin emulsion preferably has a molecular weight of 300,000 to 3,000,000, particularly 500,000 to 2,000,000, especially preferably 600,000 to 1,000,000, in terms of the maximum molecular weight (peak molecular weight) Mp in GPC. If the Mp is less than the lower limit, the fixing properties are satisfactory, but the toner is apt to cause hot offset, making the fixing temperature latitude narrower.

The resin of the resin emulsion preferably has a weight average molecular weight Mw of 50,000 or more, particularly more than 100,000, especially more than 300,000. If the Mw is less than the lower limit, the fixing properties are satisfactory, but the toner is apt to cause hot offset, making the fixing temperature latitude narrower. If desired, a polymer component having a medium molecular weight can be use in combination.

The resin of the resin emulsion includes the same kinds of resins as used as the resin of the resin solution. Styrene-based resins are particularly preferred.

The dispersed resin particles in the resin emulsion preferably have a particle size of 0.03 to 1 $\mu$m. If the particle size of the dispersed resin particles exceeds 1 $\mu$m, the resin has poor compatibility when dispersed with the resin of the resin solution serving as a low-molecular weight polymer, only to provide a toner which is has poor fixing properties and is liable to cause hot offset and have a narrow fixing temperature latitude. Dispersed particle sizes of smaller than 0.03 $\mu$m are not preferred because a required amount of an emulsifying agent to be used in emulsion polymerization must be increased, which lowers the electrical resistance of the resulting toner.

The mutual dispersibility between the resin of the resin solution and the resin of the resin emulsion is related to fixing properties and durability of a toner. If the mutual dispersibility is poor, hot offset and cold offset occurs simultaneously at the time of fixing. Further, such a toner is apt to cause a spent-toner phenomenon and be made finer, and a developer using the toner has a short life.

Emulsion polymerization for preparing the resin emulsion is carried out by mixing monomers, a water-soluble catalyst, an emulsifying agent, and water as a polymerization medium and heating the mixture to a polymerization temperature.

The starting materials may be put into a polymerization vessel all at once, and the temperature is raised to a polymerization temperature to cause polymerization, or a part or the whole of the starting materials may be put into a polymerization vessel set at a polymerization temperature either intermittently or continuously to cause polymerization. The monomer may be added to the polymerization vessel alone, or the monomer may previously be emulsified in an aqueous solution of the emulsifying agent, and the monomer emulsion may be added to the polymerization vessel.

The polymerization temperature is not particularly limited as long as the catalyst decomposes at that temperature. The temperature is arbitrary but is usually from 30 to 150° C., preferably from 40 to 100° C.

Useful monomers include those described above as examples of monomers providing the resin in the resin solution used as a low-molecular weight component and, in addition, polyfunctional crosslinking monomers having at least two polymerizable double bonds, such as aromatic divinyl compounds (e.g., is divinylbenzene and divinylnaphthalene), diethylenic carboxylic acid esters (e.g., ethylene glycol dimethacrylate, tetraethylene glycol dimethacrylate, 1,3-butanediol dimethacrylate, 1,6-hexanediol diacrylate, and allyl methacrylate), N,N'-divinylaniline, divinyl ether, and divinyl sulfide. Preferred of them are divinylbenzene, ethylene glycol dimethacrylate, and 1,6-hexanediol diacrylate.

The proportion of the unit derived from the crosslinking monomer is preferably up to 2% by weight, still preferably 0.01 to 1% by weight, particularly preferably 0.02 to 0.8% by weight.

The polymerization initiator which can be used in the emulsion polymerization is selected arbitrarily from conventional water-soluble polymerization initiators.

Suitable polymerization initiators include free radical polymerization initiators such as hydrogen peroxide, specific alkyl hydroperoxides, dialkyl peroxides, persulfates, peresters, percarbonates, ketone peroxides, and azo type initiators.

Specific examples of suitable free radical polymerization initiators include hydrogen peroxide, t-butyl hydroperoxide, ammonium persulfate, potassium persulfate, sodium persulfate, t-amyl hydroperoxide, methyl ethyl ketone peroxide, 2,2'-azobis(2-amidinopropane), and 2,2'-azobis(4-cyanovaleric acid).

The free radical polymerization initiator is preferably used in an amount of 0.03 to 1% by weight, particularly 0.05 to 0.8% by weight, especially 0.1 to 0.5% by weight, based on the total monomer.

A water-soluble redox initiator, a combination of a water-soluble peroxide and a water-soluble reducing agent, can also be used. The peroxide of the water-soluble redox initiator includes those enumerated above. The reducing agent includes sodium bisulfite, sodium pyrosulfite, sodium sulfite, a hypophosphite, ascorbic acid, and formaldehyde-sodium sulfoxylate.

The peroxide of redox initiator is used in an amount of 0.03 to 1% by weight based on the total monomer.

If desired, a trace amount of a transition metal (e.g., ferrous sulfate, Mohr's salt, copper sulfate, etc.) may be used in combination of the redox initiator.

Any of anionic emulsifying agents, nonionic emulsifying agents, cationic emulsifying agents, amphoteric emulsifying agents, and reactive emulsifying agents can be used in the emulsion polymerization of the present invention. Known emulsifying agents can be used in known manners. The emulsifying agents can be used either individually or as a combination of two or more thereof.

While emulsion polymerization is carried out as described above to obtain a resin emulsion, the resulting emulsion can have its pH adjusted, if desired, by addition of aqueous ammonia, an aqueous amine solution, an aqueous alkali hydroxide solution, etc. The emulsion to be used preferably has a solids content of 10 to 70% by weight, preferably 20 to 60% by weight, still preferably 30 to 50% by weight.

It is usually desirable for the resin emulsion to have a viscosity of not more than 10,000 cps (measured with a BH type rotational viscometer at 25° C. and 20 rpm; hereinafter the same) and a pH of 2 to 10.

In general, in emulsion polymerization, most of the monomer is converted into a polymer, with an extremely small amount of the monomer remaining unreacted. And yet where the residual monomer concentration is not sufficiently low for some uses, the residual monomer can be reduced by, for example, adding one or more initiators or reducing agents or blowing steam or air after polymerization.

While water is used as a medium of emulsion polymerization, a water-soluble solvent, such as an alcohol, may be used in combination.

The resin solution and the resin emulsion are subjected to the step of mixing with stirring, the step of removing water and the solvent and, if desired, the step of Imkneading to obtain a solventless mixed resin composition in the form of granules, pellets, flakes, etc. The composition is compounded with a colorant and, if desired, additives, such as a charge control agent, a magnetic substance, and a parting agent, and uniformly melt-kneaded. The molten mixture is cooled, if desired crushed, finely ground in a jet mill, etc., and classified with a classifier to obtain a toner for electrostatic image development having a desired particle size.

The colorant is preferably used in an amount of 1 to 200 parts by weight, particularly 3 to 150 parts by weight, per 100 parts by weight of the solventless mixed resin composition.

The colorant includes inorganic pigments, organic pigments, and synthetic dyes. Inorganic pigments or organic pigments are preferably used. One or more than one pigments and/or one or more dyes may be used in combination.

Suitable inorganic pigments include metal powder pigments, metal oxide pigments, carbon pigments, sulfide pigments, chromate pigments, and ferrocyanide pigments.

Examples of the metal powder pigments are zinc powder, iron powder, and copper powder.

Examples of the metal oxide pigments are magnetite, ferrite, red iron oxide, titanium oxide, zinc oxide, silica, chromium oxide, ultramarine, cobalt blue, cerulean blue, mineral violet, and trilead tetroxide.

Examples of the carbon pigments are carbon black, thermatomic carbon, and furnace black.

Examples of the sulfide pigments include zinc sulfide, cadmium red, selenium red, mercury sulfide, and cadmium yellow.

Examples of the chromium pigments include molybdate red, barium yellow, strontium yellow, and chromium yellow. The ferrocyanide pigments include Milori blue.

The organic pigments include azo pigments, acid dye lakes, basic dye lakes, mordant dye lakes, phthalocyanine pigments, quinacridone pigments, and dioxane pigments.

Examples of the azo pigments are Benzidine Yellow, Benzidine Orange, Permanent Red 4R, Pyrazolone Red, Lithol Red, Brilliant Scarlet G, and BON Maroon Light.

The acid dye lakes and the basic dye lakes include those obtained by precipitating dyes, such as Orange II, Acid Orange R, Eosine, Quinoline Yellow, Tartrazine Yellow, Acid Green, Peacock Blue, and Alkali Blue, with a precipitating agent; and those obtained by precipitating dyes, such as Rhodamine, Magenta, Malachite Green, Methyl Violet, and Victorian Blue, with tannic acid, potassium antimonyl tartrate, phosphotungstic acid, phosphomolybdic acid, phosphotungstomolybdic acid, etc.

Examples of the mordant dye lakes include metal salts of hydroxyanthraquinone dyes and Alizarin Madder Lake.

Examples of the phthalocyanine pigments are Phthalocyanine Blue and sulfonated copper phthalocyanine.

Examples of the quinacridone pigments and dioxane pigments are Quinacridone Red, Quinacridone Violet, and Carbazole Dioxane Violet.

The synthetic dyes include acridine dyes, Aniline Black, anthraquinone dyes, azine dyes, azo dyes, azomethine dyes, benzo and naphthoquinone dyes, indigo dyes, indophenol, indoaniline, indamine, leuco vat ester dyes, naphtholimide dyes, Nigrosine, Induline, nitro and nitroso dyes, oxazine and dioxazine dyes, oxidation dyes, phthalocyanine dyes, polymethine dyes, quinophthalone dyes, sulfur dyes, tri- and diallylmethane dyes, thiazine dyes, and xanthene dyes. Preferred of these synthetic dyes are Aniline Black, nigrosine dyes, and azo dyes. Still preferred are azo dyes having a salicylic acid, naphthoic acid or 8-oxyquinoline residual group is capable of forming a metal complex with chromium, copper, cobalt, iron, aluminum, etc.

The charge control agent includes nigrosine type electron-donating dyes, metal salts of naphthoic acid or higher fatty acids, amine alkoxides, quaternary ammonium salts, alkylamides, chelates, pigments, and fluorine-containing surface active agents for controlling positive chargeability; and electron-accepting organic complexes, chlorinated paraffin, chlorinated polyester, polyester having excess acid radical, and copper phthalocyanine sulfonylamine for controlling negative chargeability.

The parting agent includes paraffin wax and its derivatives, microcrystalline wax and its derivatives, Fisher-Tropsch wax and its derivatives, polyolefin waxes and their derivatives, and carnauba wax and its derivatives. The term "derivatives" as used herein is intended to include an oxide, a block copolymer with a vinyl monomer, and a vinyl monomer-grafted polymer.

The solventless mixed resin composition can further contain alcohols, fatty acids, acid amides, esters, ketones, hardened caster oil or derivatives thereof, vegetable waxes, animal waxes, mineral waxes, and petrolactams.

The toner for electrostatic image development thus prepared can further contain a fluidity improver. Any substance which, when added to toner particles, brings about improvement in fluidity can be used as a fluidity improver. Examples are hydrophobic colloidal silica fine powder, colloidal silica fine powder, hydrophobic titanium oxide fine powder, titanium oxide fine powder, hydrophobic alumina fine powder, alumina fine powder, and mixtures thereof.

The toner for electrostatic image development can be mixed with a carrier comprising iron powder or glass beads, preferably a carrier having a resin coat, to provide a two-component system developer.

Usage of the toner is not limited to a two-component system developer. The toner is also applicable to a one-component developer using no carrier, including a magnetic toner containing magnetic powder and a nonmagnetic toner containing no magnetic powder.

Carriers having a resin coat typically comprise core particles of iron, nickel, ferrite or glass beads coated with an insulating resin. Typical insulating resin materials include fluorine-containing resins, silicone resins, acrylic resins, styrene-acrylate copolymer resins, polyester resins, and polybutadiene resins.

When the toner obtained by the process of the present invention is used in a two-component developer containing a resin-coated carrier, it is possible to control the triboelectric characteristics of the carrier and the toner so as to markedly reduce developer fatigue due to contamination of the carrier particles by the toner particles. Such a developer with controlled triboelectric characteristics is particularly suited for use in high-speed electrophotographic copying machines for its excellent durability and long life.

The binder resin according to the present invention can be blended with other auxiliary binder resins, such as styrene-based resins and polyester resins. In this case, the proportion of the auxiliary binder resins is preferably not more than 30% by weight based on the total binder resin.

It is possible to directly prepare a toner by adding the above-described various additives to the system of preparing the binder resin for a toner for electrostatic image development together with the resin solution and the resin emulsion in accordance with the process of the present invention.

The present invention will now be illustrated in greater detail with reference to Examples and Comparative Examples.

Methods of testing carried out in Examples are as follows.

Measurement of Residual Monomer:

A residual monomer content of a solventless mixed resin composition was measured with a gas chromatograph (GC) equipped with a column 25% Thermon 1,000. A sample was dissolved in chloroform in a concentration of 2.5% and filtered by a glass filter. A 3 $\mu$l portion of the extract was passed through the column.

The monomer concentration of the sample was calculated from the calibration curve of each monomer.

Measurement of Molecular Weight:

A molecular weight of each resin was measured with a gel-permeation chromatograph (GPC) equipped with three columns (GMH, produced by Tosoh Corp.). A sample was dissolved in tetrahydrofuran (THF) in a concentration of 0.2 wt % and made to flow at a flow rate of 1 ml/min at 20° C. In the molecular weight measurement, measuring conditions were selected so that measurements on several mono-dispersed polystyrene standard samples may form a straight calibration line with the logarithm plotted as an ordinate and the count number as an abscissa.

Measurement of Particle Size:

The particle size of an emulsion was measured by making use of light scattering (with "Microtrack" manufactured by Nikkiso K.K.).

EXAMPLE 1

Preparation of Resin Solution:

An autoclave equipped with a stirrer, a heating means, a cooling means, a thermometer, and a dropping pump was purged with nitrogen gas, and a uniform monomer mixture consisting of 100 parts by weight of styrene, 50 parts by weight of xylene, and 1.5 parts by weight of di-t-butyl peroxide was put therein continuously over a 30 minute period while keeping the inner temperature at 180° C. After completion of the addition, the inner temperature was maintained at 180° C. for an additional 2 hour period, followed by cooling to obtain a resin solution. The resulting resin solution had solid content of 65%, a peak molecular weight Mp of 4,400, and a weight average molecular weight Mw of 5,000.

Preparation of Resin Emulsion:

In a container equipped with a stirrer and a dropping pump were put 27 parts by weight of deionized water and 1 part by weight of an anionic emulsifying agent (Neogen R, a trade name, produced by Kao Corp.). After dissolving by stirring, a monomer mixture consisting of 75 parts by weight of styrene, 25 parts by weight of butyl acrylate, and 0.05 part by weight of divinylbenzene was added thereto dropwise while stirring to prepare a monomer emulsion.

In a pressure reactor equipped with a stirrer, a pressure gauge, a thermometer, and a dropping pump was charged 120 parts by weight of deionized water. After displacing the atmosphere with nitrogen, the temperature was elevated to 80° C., at which a 15 wt % portion of the above-prepared monomer emulsion was added to the pressure reactor. Further, 1 part by weight of a 2 wt % potassium persulfate aqueous solution was added to carry out initial polymerization at 80° C. After completion of the initial polymerization, the temperature was raised to 85° C., at which the rest of the monomer emulsion and 4 parts by weight of a 2% potassium persulfate aqueous solution were added over 3 hours. The reaction system was maintained at that temperature for 2 hours to obtain a styrene-based resin emulsion having a solid content of 40% and a particle size of 0.13 μm.

The resulting resin emulsion exhibited a high rate of conversion and stable progress of the polymerization. The resin was separated from the resin emulsion by means of a centrifugal separator. The resulting resin was found by analysis to have a weight average molecular weight Mw of 970,000 and a peak molecular weight Mp of 720,000.

Preparation of Solventless Mixed Resin Composition:

A hundred fifty-three parts by weight of the above-prepared resin solution and 130 parts by weight of the above-prepared resin emulsion were put in the continuous mixer shown in FIG. 1 (KRC Kneader (a trade name) manufactured by Kurimoto, Ltd.), and a step of mixing with stirring, a step of heating to remove water and the solvent by evaporation, and a step of kneading were carried out in a continuous manner at a jacket temperature of 200° C. to obtain a uniformly mixed solventless resin composition having a water content of not more than 0.1 wt %. The resulting solventless mixed resin composition had a residual monomer content of 95 ppm.

Preparation of Toner:

A hundred parts by weight of the solventless mixed resin composition, 6 parts by weight of carbon black (Carbon Black MA-100 (a trade name), produced by Mitsubishi Chemical Co., Ltd.), 2 parts by weight of polypropylene wax (Viscol 550P (a trade name), produced by Sanyo Chemical Industries, Ltd.), and 2 parts by weight of a nigrosine dye (Bontron N-01 (a trade name), produced by Orient Kagaku K.K.) were mixed and ground in a ball mill, and the mixture was thoroughly kneaded by means of hot rolls set at 140° C. for 30 minutes.

After cooling, the mixture was crushed in a hammer mill and then finely ground in a jet mill. The grinds were classified in an air classifier to obtain particles of 5 to 20 μm. The particles were mixed with 0.2 part by weight of hydrophobic silica (R-972 (a trade name), produced by Nippon Aerosil K.K.) to obtain a toner having an average particle size of 9.8 μm.

The resulting toner mixed with a silicone resin-coated carrier was subjected to a copying test on a commercially available copier with a temperature sensor fitted to the fixing unit. Fixing of an image was possible from 140° C. No contamination of the fusing roller with the toner (offset) occurred even at 225° C. After producing 100,000 copies, the spent-toner phenomenon (contamination of the carrier particles with the toner) was not observed, and clear copies free from background stains or fog were obtained similarly to the initial stage.

EXAMPLE 2

Preparation of Resin Emulsion:

A resin emulsion was obtained in the same manner as in Example 1, except for using a monomer mixture consisting of 66 parts by weight of styrene, 18 parts by weight of butyl acrylate, 16 parts by weight of butyl methacrylate, and 0.03 part by weight of divinylbenzene, and using 0.8 part by weight of an anionic emulsifying agent (HITENOL N-08 (a trade name) produced by Dai-ichi Kogyo Seiyaku Co., Ltd.) as an emulsifying agent.

Preparation of Solventless Mixed Resin Composition:

A solventless mixed resin composition was prepared in the same manner as in Example 1, except for using 153 parts by weight of the resin solution prepared in Example 1 and 130 parts by weight of the above-prepared resin emulsion as resin materials.

The resulting resin composition had a water content of not more than 0.1 % and a residual monomer content of 80 ppm.

Preparation of Toner:

A toner was prepared in the same manner as in Example 1, except for replacing 100 parts by weight of the solventless mixed resin composition prepared in Example 1 with 100 parts by weight of the above-prepared solventless mixed resin composition.

A copying test using the resulting toner was carried out in the same manner as in Example 1. As a result, fixing of an image was possible from 155° C. No contamination due to offset occurred even at 230° C. Even after producing 100,000 copies, clear copies free from background stains or fog as those obtained in the initial stage were obtained.

EXAMPLE 3

Preparation of Solventless Mixed Resin Composition:

A hundred fifty-three parts by weight of the resin solution prepared in Example 1 and melted at 200° C. and 130 parts by weight of the resin emulsion prepared in Example 1 were put in a compatible twin-screw extruder manufactured by Plastic Kogaku Kenkyusho, and a mixing step and a step of removing water and the solvent by heating under reduced pressure were carried out at a jacket temperature of 200° C. to obtain an evaporation-dehydrated mixture. The resulting mixture had a residual monomer content of 60 ppm.

Preparation of Toner:

A toner was obtained in the same manner as in Example 1, except for using the above-prepared evaporation-dehydrated mixture as a solventless mixed resin composition. As a result of a copying test, fixing of an image was possible from 140° C. No contamination due to offset occurred even at 225° C. Even after 100,000 copies were produced, clear copies free from background stains or fog as those obtained in the initial stage were obtained.

COMPARATIVE EXAMPLE 1

Preparation of Suspension Polymerization Resin:

In a container equipped with a stirrer and a dropping pump were charged 200 parts by weight of deionized water and 1 part by weight of polyvinyl alcohol (PVA117 (a trade name), produced by Kuraray Co., Ltd.). After dissolving by stirring, a monomer mixture consisting of 75 parts by weight of styrene, 25 parts by weight of butyl acrylate, and 0.15 part by weight of di-t-butyl peroxyhexahydroterephthalate (Kaya Ester HTP (a trade name), produced by Nippon Kayaku Co., Ltd.) was added thereto. Polymerization was carried out at 90° C. for 8 hours while dispersing the monomer mixture under stirring to obtain a dispersion of suspension polymerization resin.

The styrene-butyl acrylate copolymer resin was separated from the resulting dispersion and dried to obtain the suspension polymerization resin.

The resulting suspension polymerization resin had an average particle size of 250 $\mu$m, a weight average molecular weight Mw of 690,000, and a peak molecular weight Mp of 550,000.

Preparation of Solventless Mixed Resin Composition:

A solventless mixed resin composition was prepared in the same manner as in Example 1, except for using 153 parts by weight of the resin solution prepared in Example 1 and 52 parts by weight of the above-prepared suspension polymerization resin.

The resulting solventless mixed resin composition had a water content of not more than 0.1% and a residual monomer content of 860 ppm.

Preparation of Toner:

A toner was prepared in the same manner as in Example 1, except for replacing 100 parts by weight of the solventless mixed resin composition prepared in Example 1 with 100 parts by weight of the above-prepared solventless mixed resin composition.

The resulting toner was subjected to a copying test in the same manner as in Example 1. As a result, the fixing was possible from a temperature as high as 165° C. Considerable offset (contamination of the fusing roller with the toner) was observed at 210° C., and the resulting copies suffered from considerable fog.

Industrial Applicability

According to the process for producing a binder resin for a toner for electrostatic image development according to the present invention, a binder resin for a toner for electrostatic image development in which a low-molecular weight polymer and a high-molecular weight polymer, which are binder resin components, are uniformly and compatibly dispersed can be produced efficiently and easily.

When a toner for electrostatic image development is produced by using the binder resin for a toner for electrostatic image development prepared by the process of the present invention, there is obtained efficiently and easily a toner for electrostatic image development in which a low-molecular weight polymer, a high-molecular weight polymer, and a colorant are uniformly and compatibly dispersed and which has reduced odor and exhibits satisfactory characteristics, such as anti-offset properties, fixing properties, grindability in the production thereof, antiblocking properties (resistance to agglomeration) during storage, and developing properties in image formation.

What is claimed is:

1. A process for producing a binder resin for a toner for electrostatic image development comprising the steps of (1) mixing a resin solution and a resin emulsion with stirring and (2) removing water and solvent simultaneously with or after the step (1) to obtain a solventless mixed resin composition; and wherein the resin of the resin solution has a gel permeation chromatogram (GPC) peak molecular weight Mp of 1,500 to 30,000 and a weight average molecular weight (Mw)/number average molecular weight (Mn) ratio of less than 4.0, and the resin of the resin emulsion has a gel permeation chromatogram (GPC) peak molecular weight Mp of 300,000 to 3,000,000.

2. A process according to claim 1, wherein the solvent of the resin solution is a solvent having a solubility parameter (SP) value of 6 to 12.

3. A process according to claim 1, wherein the resin solution is a resin solution obtained by solution polymerization.

4. A process according to claim 1, wherein the resin emulsion is an emulsion of a polymer obtained by emulsion polymerization.

5. A process according to claim 1, wherein the resin of the resin solution is a styrene-based resin having a weight average molecular weight of not more than 200,000, and the resin of the resin emulsion is a styrene-based resin having a weight average molecular weight of not less than 50,000.

6. A process according to claim 1, wherein the resin of the resin solution and the resin of the resin emulsion are present in proportions of 50 to 80 parts by weight and 20 to 50 parts by weight, respectively, per 100 parts by weight of their total amount.

7. A process according to claim 1, wherein the process includes a step of (3) kneading after the steps of (1) mixing with stirring and (2) removing water and the solvent.

8. A process for producing a toner for electrostatic image development comprising the steps of (1) mixing a resin solution and a resin emulsion with stirring, (2) removing water and solvent simultaneously with or after the step (1) to obtain a solventless mixed resin composition, and (4) incorporating a colorant into the solventless mixed resin composition, and wherein the resin of the resin solution has a gel permeation chromatogram (GPC) peak molecular weight Mp of 1,500 to 30,000 and a weight average molecular weight (Mw)/number average molecular weight (Mn) ratio of less than 4.0, and the resin of the resin emulsion has a gel permeation chromatogram (GPC) peak molecular weight Mp of 300,000 to 3,000,000.

* * * * *